US008365695B2

(12) United States Patent
Wakamatsu et al.

(10) Patent No.: US 8,365,695 B2
(45) Date of Patent: Feb. 5, 2013

(54) INTAKE MANIFOLD FOR INTERNAL COMBUSTION ENGINE

(75) Inventors: Takeshi Wakamatsu, Saitama (JP); Tsutomu Tsukii, Saitama (JP); Yoshihiro Akiyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 221 days.

(21) Appl. No.: 12/601,764

(22) PCT Filed: May 14, 2008

(86) PCT No.: PCT/JP2008/058843

§ 371 (c)(1), (2), (4) Date: Nov. 24, 2009

(87) PCT Pub. No.: WO2008/149646

PCT Pub. Date: Dec. 11, 2008

(65) Prior Publication Data

US 2010/0162984 A1 Jul. 1, 2010

(30) Foreign Application Priority Data

May 30, 2007 (JP) ..... 2007-144104

(51) Int. Cl.
*F02M 35/10* (2006.01)

(52) U.S. Cl. ..... 123/184.21; 123/184.24

(58) Field of Classification Search ..... 123/184.21–184.61, 447, 452, 461, 514
See application file for complete search history.

(56) References Cited

U.S. PATENT DOCUMENTS 4,854,271 A * 8/1989 Miyano et al. ..... 123/184.31
(Continued)

FOREIGN PATENT DOCUMENTS

EP 1508685 A1 2/2005
JP 11-210576 8/1999
(Continued)

OTHER PUBLICATIONS

International Search Report for Application No. PCT/JP2008/058843, dated Aug. 26, 2008.

(Continued)

*Primary Examiner* — Nathaniel Wiehe
*Assistant Examiner* — Tea Holbrook
(74) *Attorney, Agent, or Firm* — Nelson Mullins Riley & Scarborough LLP; Anthony A. Laurentano

(57) ABSTRACT

An intake manifold M for an internal combustion engine has two or more structural members P1 to P3 including a first structural member P1 integrally provided with an inlet flange 22 to which a throttle device 4 is connected, and an outlet flange 40 to be joined to a cylinder head 2 provided with intake ports 5. The first structural member P1 is provided integrally with an inlet part 21 forming at least part of an inlet passage 11 and including the inlet flange 22. The outlet flange 40 is formed integrally with the inlet part 21 so as to extend across a direction in which the inlet passage 11 extends, two bolts $\mathbf{45}_1$ and $\mathbf{45}_2$ for fastening the outlet flange 40 to the cylinder head are disposed respectively on the opposite sides of the inlet passage 11. The rigidity of the inlet flange and fastening of the outlet flange to the cylinder head by fastening means improves a vibration reducing effect on a throttle device joined to the inlet flange.

5 Claims, 5 Drawing Sheets

U.S. PATENT DOCUMENTS

| | | | | |
|---|---|---|---|---|
| 5,005,532 | A * | 4/1991 | Shillington | 123/184.42 |
| 5,630,386 | A * | 5/1997 | Uchida | 123/184.34 |
| 6,475,046 | B2 * | 11/2002 | Muramatsu et al. | 440/88 R |
| 6,604,500 | B2 * | 8/2003 | Miyahara et al. | 123/184.61 |
| 6,805,089 | B2 * | 10/2004 | Kemper et al. | 123/184.61 |
| 2004/0200450 | A1 | 10/2004 | Tanikawa et al. | |

FOREIGN PATENT DOCUMENTS

| | | |
|---|---|---|
| JP | 2001-115912 | 4/2001 |
| JP | 2004-308506 | 11/2004 |
| JP | 2004-346946 | 12/2004 |
| JP | 2007-9884 | 1/2007 |

OTHER PUBLICATIONS

Supplementary European Search Report for Application No. 08752714.9, dated Apr. 26, 2011.

* cited by examiner

INTAKE MANIFOLD FOR INTERNAL COMBUSTION ENGINE

RELATED APPLICATIONS

This application is a 35 U.S.C. 371 national stage filing of International Application No. PCT/JP2008/058843, filed May 14, 2008, which claims priority to Japanese Patent Application No. 2007-144104 filed on May 30, 2007 in Japan. The contents of the aforementioned applications are hereby incorporated by reference.

TECHNICAL FIELD

The present invention relates to an intake manifold for an internal combustion engine and, more particularly, to an intake manifold formed by joining together two or more structural parts and defining an intake passage.

BACKGROUND ART

A known intake manifold for an internal combustion engine, defining an intake passage, disclosed in, for example, Patent Document 1 is formed by joining together two or more structural parts. One of the structural parts is integrally provided with an inlet connecting part to be joined to a throttle device, an outlet flange to be joined to the cylinder head of the internal combustion engine, and a connecting part connecting the inlet connecting part and the outlet flange. The joining parts of the structural parts are joined together to build the intake manifold.

Patent Document 1: JP 2004-308506 A

DISCLOSURE OF THE INVENTION

Underlying Problem to be Solved by the Invention

Since the inlet connecting part, the outlet flange and the connecting part of the structural member are combined integrally in a unitary manner, the vibration of the inlet connecting part caused by the vibration of the operating internal combustion engine is reduced, and the vibration of an intake passage forming device, such as a throttle device, is reduced. However, the connecting part extends in the inlet connecting part only in a part near the outlet flange. Therefore, when the throttle device, namely, the intake passage forming device, is provided with, for example, a motor for driving a throttle valve and has a comparatively large weight or when the internal combustion engine is a high-power engine that vibrates considerably, the rigidity of a part around the inlet connecting part is not high enough to suppress vibrations satisfactorily.

The present invention has been made in view of such a problem and it is therefore an object of the present invention to provide a split intake manifold including a plurality of structural members including one structural member integrally having an inlet connecting part and an outlet flange, wherein vibrations of the inlet connecting part is reduced by the rigidity of the outlet flange and by fastening the outlet flange to a passage forming part of an engine by fastening means to improve a vibration reducing effect on an intake passage forming part joined to the inlet connecting part.

Means to Solve the Underlying Problem Disclosure of the INVENTION

The present invention provides an intake manifold for an internal combustion engine, comprising two or more structural members joined together to define an intake passage having an inlet passage and outlet passages, the structural members including a first structural member integrally provided with an inlet connecting part to which is connected an intake passage forming part through which air is taken in, and an outlet flange to be joined to a passage forming part of the internal combustion engine, provided with intake ports into which intake gas from the outlet passages flows; wherein the first structural member is provided integrally with an inlet part forming at least part of the inlet passage and having the inlet connecting part; the outlet flange is formed integrally with the inlet part so as to extend across a direction in which the inlet passage extends; and fastening means for fastening the outlet flange to passage forming part of the internal combustion engine, are disposed respectively on opposite sides of the inlet passage.

In the intake manifold according to the present invention, the first structural member may be integrally provided with connecting means for connecting the first structural member to a body of the internal combustion engine.

According to the present invention, the internal combustion engine may be provided with a plurality of cylinders arranged in a predetermined cylinder arranging direction, and the connecting means may be located nearer to the inlet connecting part than a middle part of the intake manifold with respect to the cylinder arranging direction.

The outlet flange may have an extension part extending outside the inlet passage across a direction in which the inlet passage extends, and the extension part of the outlet flange and the inlet part defining the inlet passage may be integrally formed in a unitary manner.

In a preferred embodiment of the invention, the outlet flange has an extension part extending outside the inlet passage across a direction in which the intake passage extends, and the extension part of the outlet flange and the inlet part defining the inlet passage are connected by reinforcing ribs formed integrally with the first structural member.

In a preferred embodiment of the invention, the internal combustion engine has a plurality of cylinders, and the intake manifold has an expanded chamber having a passage area larger than that of the inlet passage, a plurality of branch passages branching out from the expanded chamber to carry intake gas to the plurality of cylinders, a second structural member joined to the first structural member to form the expanded chamber, and a third structural member joined to the first structural member to define the plurality of branch passages.

Effect of the Invention

According to the present invention, the outlet flange is formed integrally with an inlet part including the inlet connecting part to supplement the rigidity of the inlet part by the rigidity of the outlet flange. Consequently, the vibration of the inlet connecting part is reduced. Since the outlet flange extends across a direction in which the inlet passage extends, and the two fastening means fastening the outlet flange to the passage forming part of the engine are disposed respectively on the opposite sides of the inlet passage, the rigidity of the inlet part is further improved, the vibration of the inlet connecting part can be still more effectively reduced, and the vibration reducing effect on the intake passage forming part is improved.

Since the connecting part to be joined to the engine body of the internal combustion engine is formed integrally with the first structural member, the rigidity of the first structural member integrally provided with the inlet connecting part is enhanced by the connecting part joined to the engine body. Consequently, the vibration of the inlet connecting part is reduced, and the vibration reducing effect on the intake passage forming part is improved.

Since the connecting part is nearer to the inlet connecting part than a middle part of the intake manifold with respect to the cylinder arranging direction, the rigidity of the outlet flange is enhanced. Consequently, the vibration of the outlet flange is reduced, and the vibration reducing effect on the throttle is improved still further.

Since the outlet flange has the extension part extending outside the inlet passage across a direction in which the intake passage extends, and the extension part and the inlet part forming the inlet passage are combined integrally in a unitary manner, the outlet flange securely holds the intake manifold on the engine, and the rigidity of the inlet part can be enhanced by forming the extension part integrally with the inlet part. Connection of the extension part and the inlet part by the reinforcing ribs enhances the rigidity of the inlet part still further.

The internal combustion engine has the plurality of cylinders, and the intake manifold has the expanded chamber having a passage area larger than that of the inlet passage, the plurality of branch passages branching out from the expanded chamber to carry intake gas to the plurality of cylinders, the second structural member joined to the first structural member to form the expanded chamber, and the third structural member joined to the first structural member to define the plurality of branch passages. Therefore, the intake manifold can be readily built by assembling the tree structural members.

DESCRIPTION OF REFERENCE SIGNS

2 . . . Cylinder head, 4 . . . Throttle device, 10 . . . Intake passage, 11 . . . Inlet passage, 21 . . . Inlet part, 22 . . . Inlet flange, 40 . . . Outlet flange, 42 . . . Extension part, 44, $\mathbf{44}_1$ and $\mathbf{44}_2$ . . . Fastening parts, 45, $\mathbf{45}_1$ and $\mathbf{45}_2$ . . . Bolts, 51 and 52 . . . Bosses, 53 . . . Stay, M . . . Intake manifold, P1 to P3 . . . Structural members.

BEST MODE FOR CARRYING OUT THE INVENTION

A preferred embodiment of the present invention will be described with reference to FIGS. 1 to 5.

Figure 1:
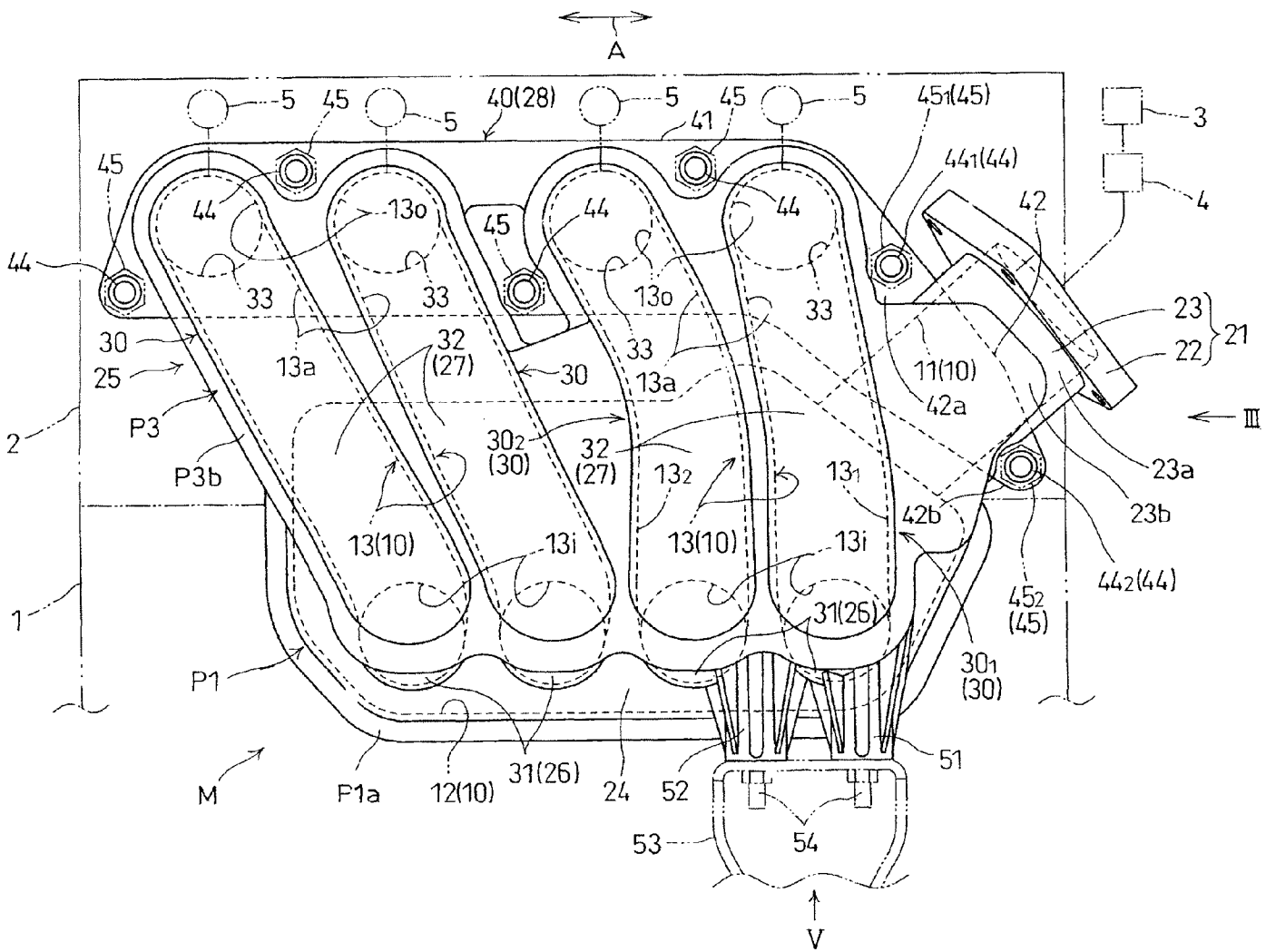
FIG. 1 is a front elevation of an intake manifold in a preferred embodiment of the present invention taken from a direction perpendicular to a flange-attaching surface in a cylinder head.

Referring to FIG. 1, an intake manifold M in a preferred embodiment of the present invention is incorporated into an inline four-cylinder internal combustion engine, namely, a multiple-cylinder internal combustion engine. The internal combustion engine has an engine body including a cylinder block 1 provided with a predetermined number of cylinders, four cylinders, arranged in a straight line in a cylinder arranging direction A, a cylinder head 2 joined to the upper end of the cylinder block 1, a lower block joined to the lower end of the cylinder block 1, and an oil pan attached to the lower end of the lower block. A lower part of the cylinder block 1, the lower block and the oil pan form a crankcase in which the crankshaft of the internal combustion engine is disposed.

The internal combustion engine is provided with pistons respectively fitted in the cylinders so as to reciprocate and driven by combustion gas generated by the combustion of an air-fuel mixture in combustion chambers to drive the crankshaft for rotation, an intake system for carrying intake gas into the combustion chambers, and an exhaust system for carrying the combustion gas as an exhaust gas from the combustion chambers to the outside of the internal combustion engine. The combustion chambers are spaces defined by the cylinders, the pistons fitted in the cylinders, and the cylinder head 2.

The intake system includes an air cleaner 3 for cleaning air taken in from outside the internal combustion engine, a throttle device 4 provided with a throttle valve for controlling the flow of intake gas that has passed through the air cleaner 3, and the intake manifold M for carrying intake gas at a flow rate determined by the throttle device 4 to each of the combustion chambers. The intake gas that has flowed through the intake manifold M flows through an intake port 5 formed in the cylinder head 2 into each of the combustion chambers.

Herein "intake gas" signifies air or an air-fuel mixture when fuel is supplied through a fuel injection valve into an intake passage formed in the intake system or signifies air when fuel is supplied directly into the combustion chambers.

The intake passage formed in the intake system is defined by the intake manifold M. The intake passage has a downstream intake passage 10 defined by the intake manifold M and connecting to the intake ports 5, and an upstream intake passage including an intake passage defined by the throttle body of the throttle device 4 and extending on the upstream side of the intake passage 10.

The terms "upstream" and "downstream" are used for indicating positions, directions and such with respect to the direction of flow of the intake gas.

Figure 2:
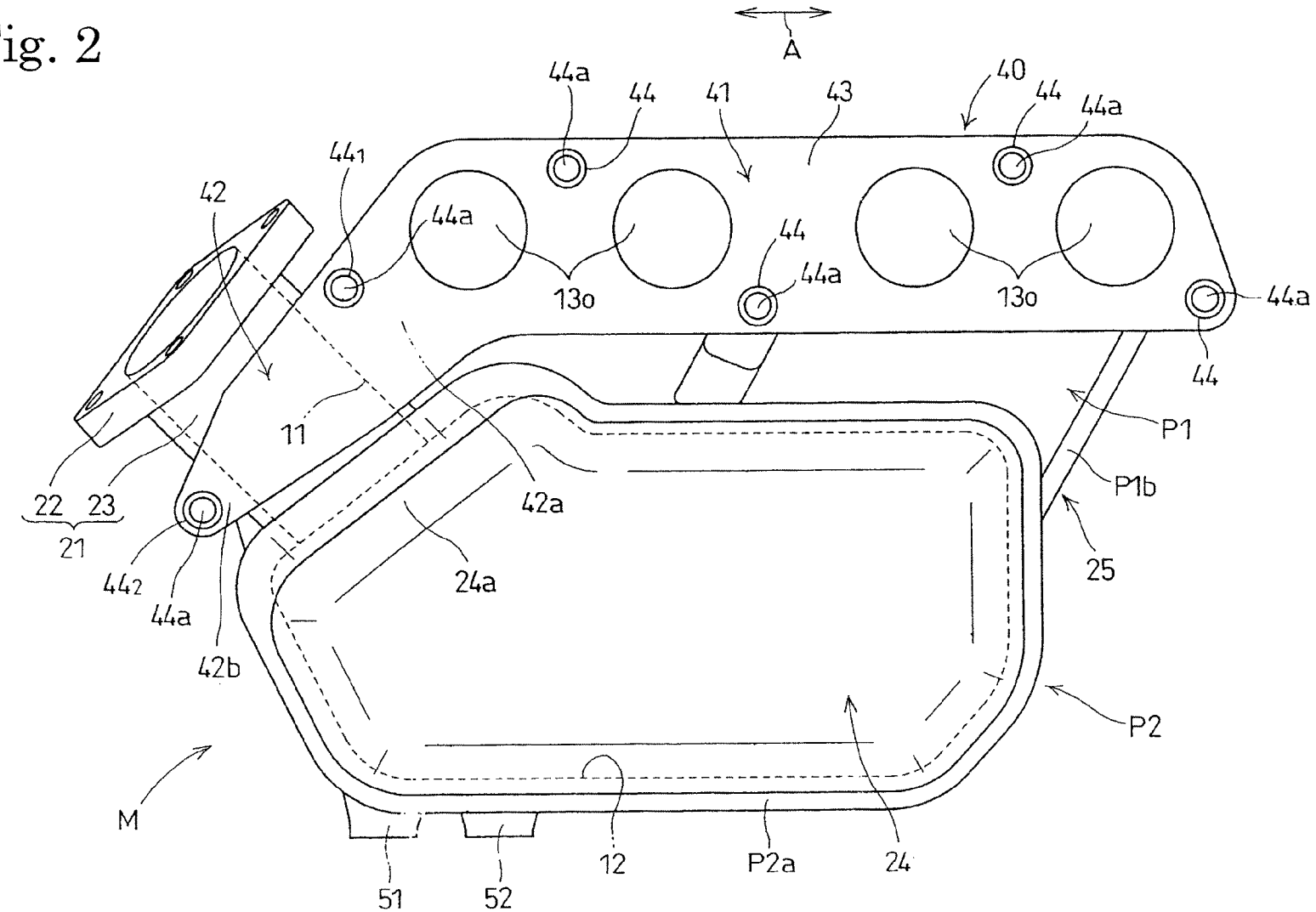
FIG. 2 is a rear elevation of the intake manifold shown in FIG. 1 taken in a direction perpendicular to the flange-attaching surface in the cylinder head.
Figure 3:
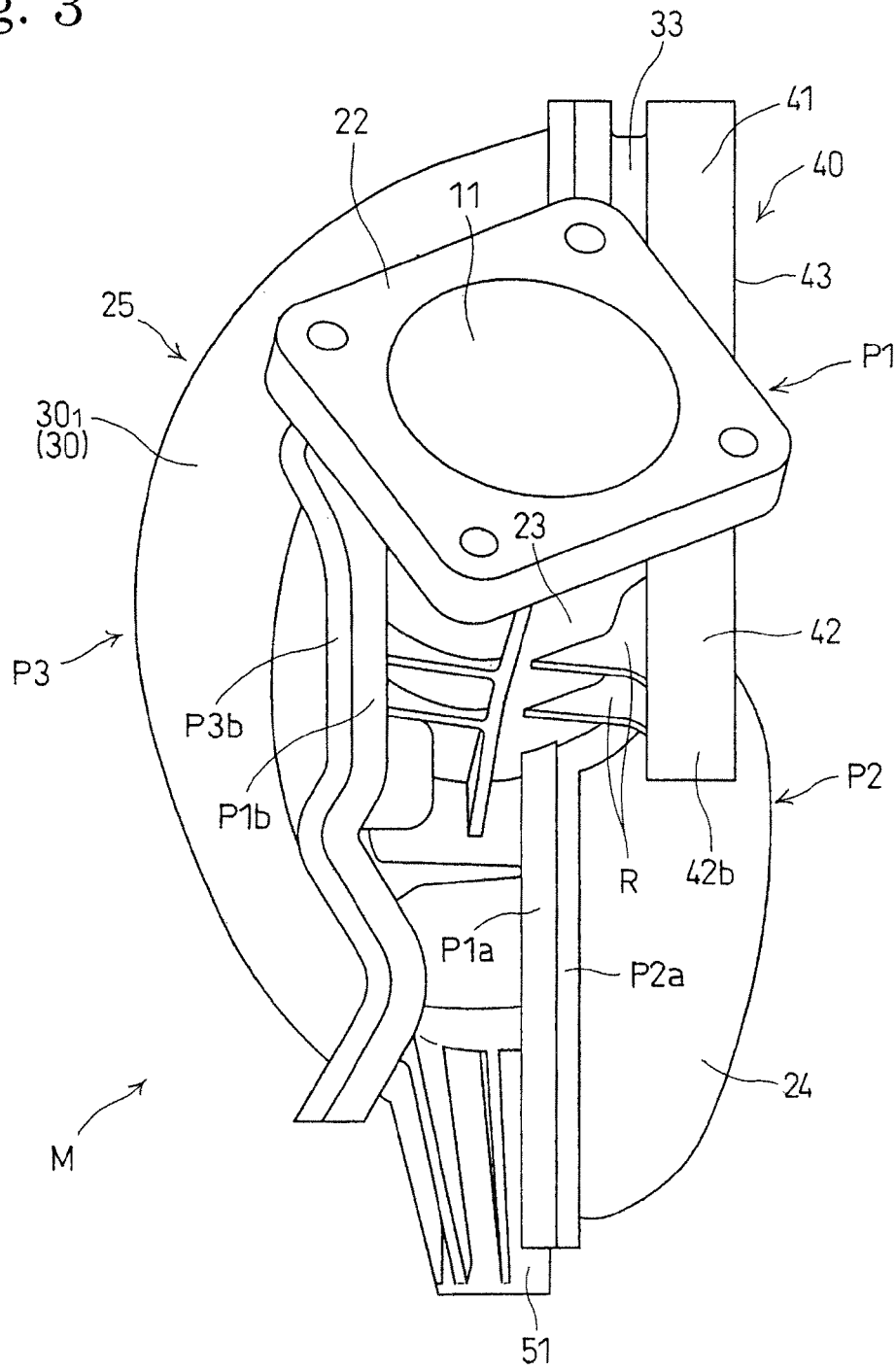
FIG. 3 is a view seen in the direction of the arrow III in FIG. 1.
Figure 4:
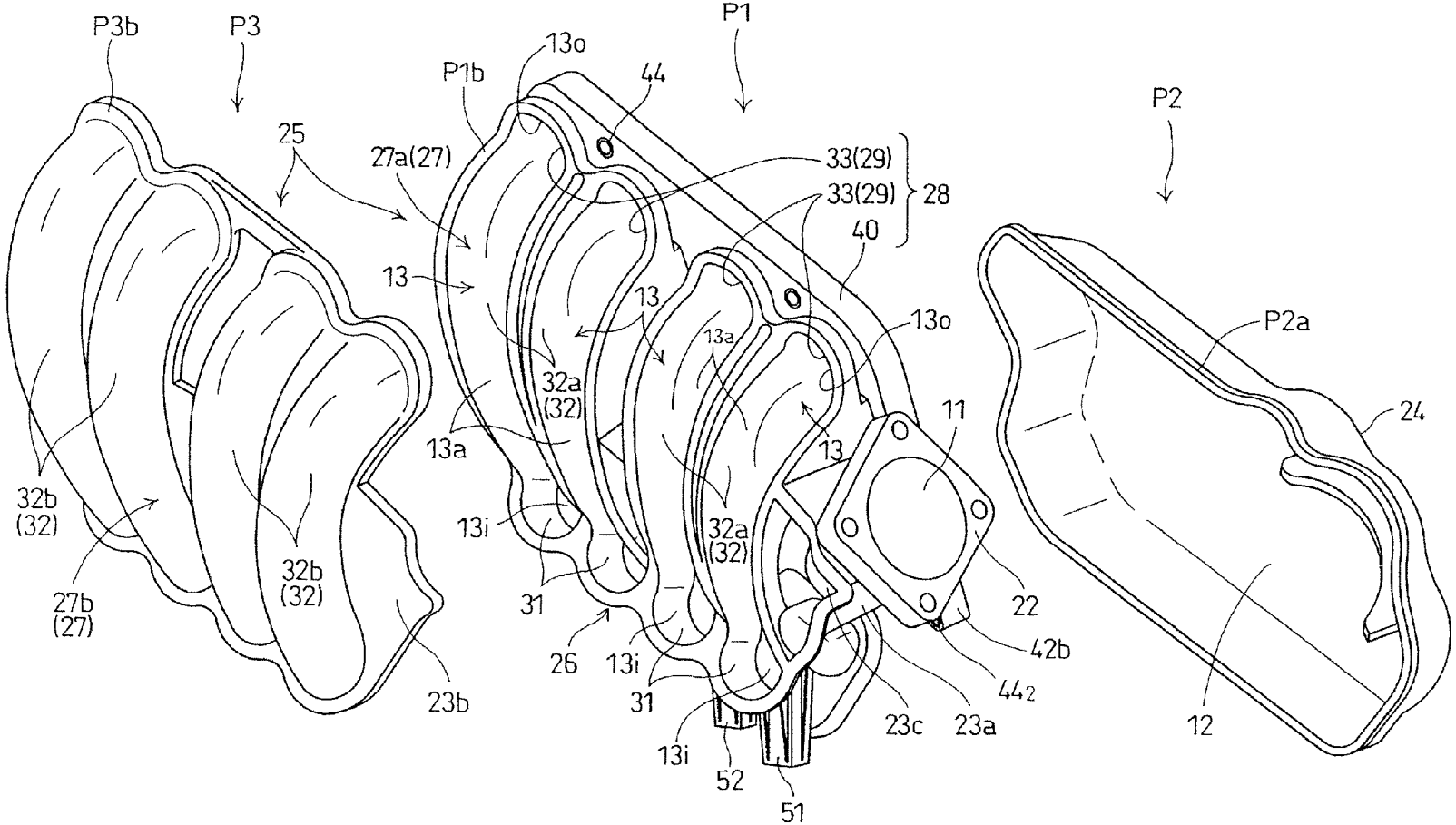
FIG. 4 is an exploded perspective view of the intake manifold shown in FIG. 1.

Referring to FIGS. 1 to 4, particularly to FIGS. 3 and 4, the intake manifold M in this embodiment is built by hermetically joining together more than two structural members (three structural members in the manifold M shown), namely, a first structural member P1, a second structural member P2 and a third structural member P3. The structural members P1 to P3 are unitary members made of a synthetic resin. Respective rims P1*a* and P2*a*, namely, joining parts, of the first structural member P1 and the second structural member P2 are joined together, and respective rims P1*b* and P3*b*, namely, joining parts, of the first structural member P1 and the third structural member P3 are joined together by thermal bonding, namely, by joining means. Thus the intake manifold M is a split resin intake manifold formed by joining together the three structural members P1 to P3. The intake passage 10 is formed by joining together the three structural members P1 to P3.

The intake manifold M has an inlet flange 22, namely, an inlet connecting part to which the throttle body is connected, and an outlet flange 40, namely, an outlet connecting part to be fastened to the cylinder head with two or more fastening means, namely, six bolts 45 (FIG. 1) in this embodiment. The throttle body provided with an electric motor for driving the throttle valve is fastened to the inlet flange 22 with bolts, not shown, namely, fastening means. Thus the throttle body is supported at least partly by the intake manifold M.

As best shown in FIG. 2, the intake passage 10 has an inlet passage 11 that receives the intake gas from the intake passage of the throttle device 4, an intake gas collection chamber 12, and a predetermined number (four in the manifold shown) of branch passages 13 branching out from the collection chamber 12 to deliver the intake gas to the intake ports 5 of the cylinder head 2. The collection chamber 12 is on the downstream side of the inlet passage 11 and is an expanded chamber having a passage area greater than the passage area of the inlet passage 11 and greater than the passage area of each of the branch passages 13.

Thus the intake manifold M comprises an inlet part 21 provided with an inlet flange 22 and forming at least part of the inlet passage 11, a collection part 24 disposed on the downstream side of the inlet part 21 and defining the collection chamber 12, and a branch part 25 connecting to an outlet flange 40 and defining all the branch passages 13.

The intake gas flowing from the intake passage provided with the throttle valve into the intake passage 10 flows successively through the inlet passage 11, the collection chamber 12, the branch passages 13, and the intake ports 5 into the combustion chambers.

The throttle device 4 is a passage forming part defining the intake passage through which the intake gas flows into the intake manifold M or the intake passage 10 or through which the intake gas flows into the inlet passage 11. The cylinder head 2 is a passage forming part forming the intake ports 5 through which the intake gas that has flowed through the intake manifold M or the intake passage 10 flows. Thus the cylinder head 2 is a passage forming part of the internal combustion engine into which the intake gas flows through outlet passages 13*o*, namely, downstream end parts of the branch passages 13.

The inlet part 21 formed by joining together the first structural member P1 and the third structural member P3 is made up of the inlet flange 22 formed in the first structural member P1, and a tube portion 23 connecting the inlet flange 22 to the collection part 24. As shown in FIG. 1, the tube portion 23 has a body 23*a* connecting to the inlet flange 22 and formed integrally with the first structural member P1, and a cover portion 23*b* which covers an opening 23*c* (FIG. 4) formed in the body 23*a* and is formed integrally with the third structural member P3.

As obvious from FIG. 2, the inlet part 21 of the collection part 24 formed by combining the first structural member P1 and the third structural member P3 connects to an end part 24*a* with respect to the cylinder arranging direction A in which the cylinders are arranged in the cylinder block 1.

The branch part 25 formed by combining the first structural member P1 and the second structural member P3 has four branch pipes 30 respectively defining the branch passages 13. The branch pipes 30 and the branch passages 13 are arranged in the cylinder arranging direction A. Each of the branch pipes 30 has an inlet part 31 forming an inlet passage 13*i* opening into the collection part 24, an outlet part 33 forming an outlet passage 13*o* opening into the intake port 5, and a middle part 32 forming a middle passage 13*a* extending between the inlet passage 13*i* and the outlet passage 13*o*.

The branch part 25 has an inlet part 26 having the four inlet parts 31, a middle part 27 having the four middle parts 32, and an outlet part 28. The outlet part 28 includes the outlet flange 40, and the paired outlet parts 33 connecting to the outlet flange 40.

An inlet part 26, the outlet part 28 including the outlet flange 40, and an inner part 27*a* of the middle part 27 are formed integrally with the first structural member P1. An outer part 27*b* of the middle part 27 is formed integrally with the third structural member P3. The inner part 27*a* includes an inner part 32*a* of the middle part 32. The outer part 27*b* includes the outer part 32*b* of the middle part 32. The inner part 27*a* joined to the outer part 27*b* covering the branch passages 13 from a side opposite the side of the collection chamber 12 separates the branch passages 13 from the collection chamber 12.

The outlet flange 40 has a joining surface 43 to be joined to the cylinder head 2, a main part 41 extending substantially parallel to the cylinder arranging direction A, and an extension part 42. The extension part 42 is formed integrally with the body 23*a* of the tube portion 23. The extension part 42 extends from a part, near the inlet part 21, of the main part 41 at an angle to the main part 41 which extends in the cylinder arranging direction A. The extension part 42 extends to the outside of the inlet part 21 defining the inlet passage 11 across a direction in which the inlet passage 11 extends. The extension part 42 extends at an angle to the inlet passage 11. In this embodiment, the extension part 42 extends perpendicularly to a direction in which the intake gas flows in the inlet passage 11. When the outlet flange 40 is joined to the cylinder head 2, the joining surface 43 in contact with the cylinder head 2 is in a plane substantially parallel to the cylinder arranging direction A.

The tube 23 and the extension part 42 are connected by a plurality of reinforcing ribs R (FIG. 3) formed integrally with the first structural member P1. The reinforcing ribs R enhance the rigidity of the tube 23.

As shown in FIG. 2, the outlet flange 40 has six fastening parts 44 to be fastened to the cylinder head 2 with the six bolts 45, respectively. The bolts 45 passed through openings 44*a* formed in the fastening parts 44 are screwed into threaded holes formed in the cylinder head 2.

At least a pair of bolts $\mathbf{45}_1$ and $\mathbf{45}_2$ fastening a pair of fastening parts $\mathbf{44}_1$ and $\mathbf{44}_2$ among the fastening parts 44 fastened to the cylinder head 2 with the bolts 45 are on the opposite sides, respectively, of the inlet passage 11 or the tube portion 23 as viewed in a direction perpendicular to the joining surface 43, which will be referred to as "perpendicular direction". Here, "at least a pair of bolts $\mathbf{45}_1$ and $\mathbf{45}_2$ fastening a pair of fastening parts" includes a case in which more than one pair of bolts fastening more than one pair of fastening parts are provided, as well as a case in which the number of the bolts fastening the fastening parts on one side of the inlet passage 11 or the tube portion 23 is different from the number of the bolts fastening the fastening parts on the other side.

More concretely, the bolt $\mathbf{45}_1$ and the fastening part $\mathbf{44}_1$ are in a base region 42*a* of the extension part 42 at a position between the branch pipe $\mathbf{30}_1$ (or the branch passage $\mathbf{13}_1$) nearest to the inlet flange 22 with respect to the cylinder arranging direction, and the tube portion 23. The other bolt $\mathbf{45}_2$ and the fastening part $\mathbf{44}_2$ are in an end region 42*b* of the extension part 42 on a side opposite the side of the bolt $\mathbf{45}_1$ and the fastening part $\mathbf{44}_1$ with respect to the inlet passage 11 or the tube portion 23 as viewed from the perpendicular direction.

Figure 5:
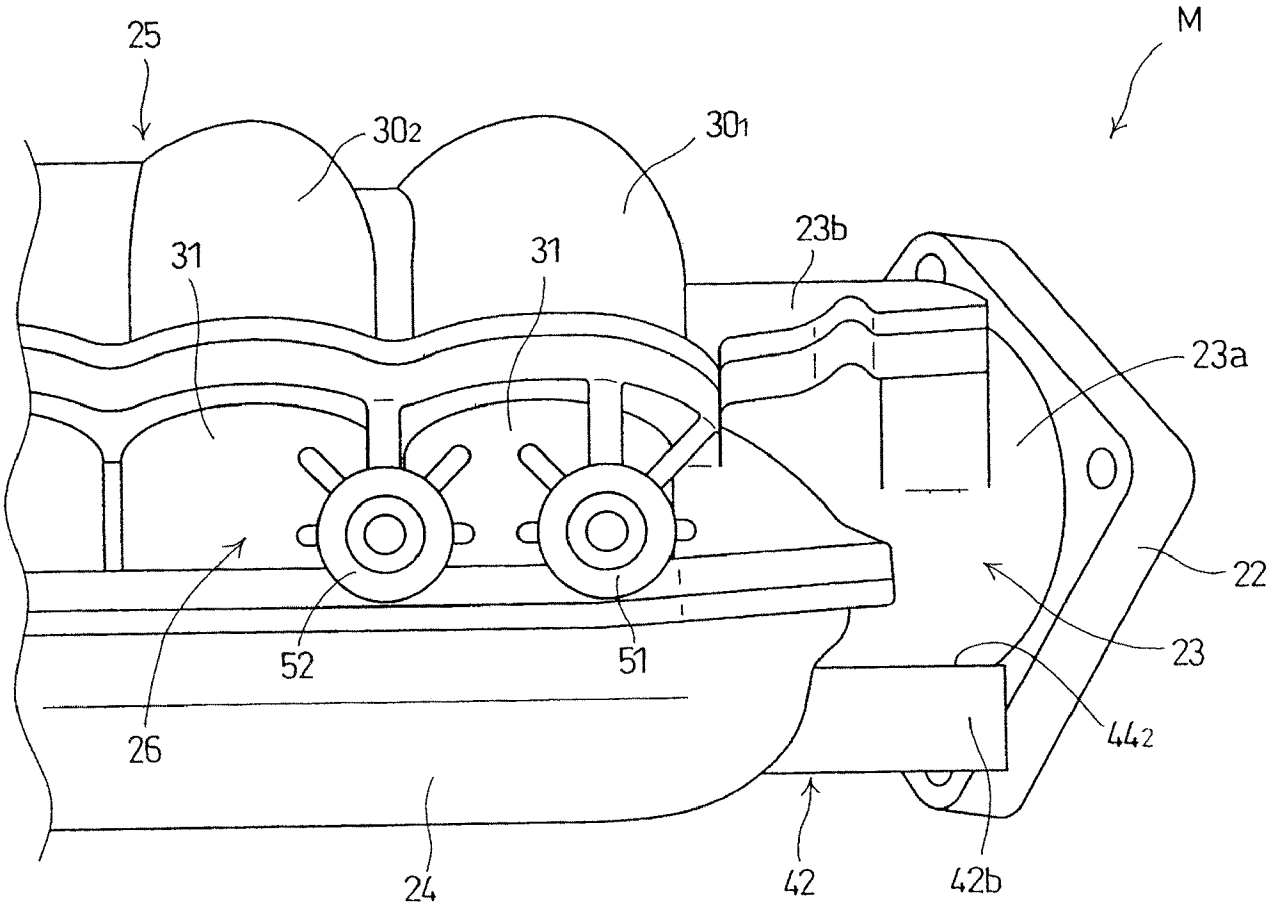
FIG. 5 is a view of an essential part seen in the direction of the arrow V in FIG. 1.

Referring to FIGS. 1 and 5, the branch part 25 is provided with one or more bosses, two bosses 51 and 52 in this embodiment. A stay 53, namely, a support member, fastened to the lower block of the engine body with bolts, not shown, is fastened to the bosses 51 and 52 with bolts 54, namely, fastening means. The bosses 51 and 52 are connecting means for connecting the intake manifold M through the stay 53 to the lower block.

The bosses 51 and 52 are formed integrally with the inlet part 26 of the first structural member P1. The boss 51 is at a position corresponding to the branch pipe $\mathbf{30}_1$ (or the branch passage $13_1$) with respect to the cylinder arranging direction A. The boss 52 is at a position in a part extending between the branch pipe $30_1$ (or the branch passage $13_1$) and the branch pipe $30_2$ (or the branch passage $13_2$) adjacent to the branch pipe $30_1$ (or the branch passage $13_1$). The bosses 51 and 52 are nearer to the inlet flange 22 than the middle of the branch part 25 defining the branch passages and the middle of the intake manifold M with respect to the cylinder arranging direction A.

The bosses 51 and 52 of the intake manifold M are formed in the inlet part 26 corresponding to the inlet ends of the branch passages 13 opposite to the outlet flange 40 formed in the outlet part 28 corresponding to the outlet ends of the branch passages 13. Thus the outlet flange 40 and the bosses 51 and 52 on the opposite sides, respectively, of the intake manifold M enhance the rigidity of the intake manifold M effectively and reduce the vibration of the inlet flange 22.

Operations and effects of the intake manifold M will be described.

The inlet flange 22 to which the throttle device 4 is joined, and the outlet flange 40 to be joined to the cylinder head 2 provided with the intake ports 5 are formed integrally with the first structural member P1 among the structural members P1 to P3 forming the intake manifold M made of the resin. The inlet passage 11 of the intake passage 10 is formed in the first structural member P1, and the inlet part 21 provided with the inlet flange 22 is formed integrally with the first structural member P1. The outlet flange 40 is formed integrally with the inlet part 21 and extends at an angle to the inlet passage 11. The fastening parts $44_1$ and $44_2$ of the outlet flange 40 to be fastened to the cylinder head 2 with the bolts $45_1$ and $45_2$ are on the opposite sides, respectively, of the inlet passage 11. Since the outlet flange 40 is formed integrally with the inlet part 21 provided with the inlet flange 22, the outlet flange 40 enhances the rigidity of the inlet part 21, thus reducing the vibration of the inlet flange 22 still further. Consequently, the vibration reducing effect on the throttle device 4 is improved.

Since the two bosses 51 and 52 as the connecting means to the lower block of the engine body are formed integrally with the first structural member P1, the bosses 51 and 52 connected to the lower block enhances the rigidity of the first structural member P1 provided with the inlet flange 22. Consequently, the vibration of the inlet flange 22 is reduced whereby the vibration reducing effect on the throttle device 4 can be improved.

Since the bosses 51 and 52 are at positions corresponding to or near the branch pipe $30_1$ (or the branch passage $13_1$) nearest to the inlet flange 22 with respect to the cylinder arranging direction A, the bosses 51 and 52 are nearer to the inlet flange 22 than the middle of the branch part 25 defining the branch passages and the middle of the intake manifold M with respect to the cylinder arranging direction A. Therefore, the rigidity of the branch part 25 and the inlet flange 22 of the intake manifold M is enhanced. Consequently, the vibration of the inlet flange 22 is reduced and the vibration reducing effect on the throttle device 4 is improved still further.

An intake manifold in a modification of the above-mentioned intake manifold M will be described. Only parts of the intake manifold in the modification which are different from the corresponding parts of the intake manifold M will be described.

Whereas the intake manifold M in the foregoing embodiment is built by assembling the three structural members P1 to P3, the intake manifold may be built by assembling a number of structural members other than the three structural members, such as two or four structural members.

The inlet part 21 provided with the inlet flange 22 may be located between a pair of the branch pipes 30 adjacent to each other with respect to the cylinder arranging direction A. In such a case, the fastening means are disposed on the opposite sides, respectively, of the inlet passage 11 with respect to the cylinder arranging direction A.

The inlet flange 22 may be fastened to the cylinder head 2 with fastening means other than the bolts.

The throttle device 4 may be replaced with a carburetor which mixes fuel with air to produce an air-fuel mixture. The intake passage forming part may be a part other than the throttle device 4, such as a passage forming part which is not provided with a throttle valve.

The bosses 51 and 52 may be fastened directly to a part of the engine body, such as the lower block or the cylinder block 1 without using the stay 53.

The passage forming member of the internal combustion engine may be a member other than the cylinder head. For example, the intake manifold M does not necessarily need to be connected directly to the cylinder head 2. The intake manifold M may be connected to a passage forming member connected to the cylinder head 2. More concretely, between the intake manifold M and the cylinder head 2 may be interposed an injector base formed by attaching fuel injection valves for injecting fuel into intake ports to a plate provided with the intake ports respectively for the cylinders. An EGR distribution plate, which is provided with intake ports respectively for the cylinders and a distribution passage for distributing EGR gas to the intake ports, may be interposed as a passage forming member between the intake manifold M and the cylinder head 2.

The multiple-cylinder internal combustion engine may be an internal combustion engine provided with a number of cylinders greater than four. The internal combustion engine may be a V-type internal combustion engine having two banks each having a plurality of cylinders.

Although the invention has been described as applied to the internal combustion engine for a vehicle, the present invention is applicable also to marine propulsion devices, such as an outboard motor provided with a vertical crankshaft.

The invention claimed is:

1. An intake manifold for an internal combustion engine, comprising two or more structural members joined together to define an intake passage including an inlet passage, an intake gas collection chamber, a plurality of branch passages, and outlet passages, said structural members including a first structural member, which is integrally provided with:

an inlet connecting part to which is connected an intake passage forming part through which air is taken in, an outlet flange to be joined to a passage forming part of the internal combustion engine, provided with intake ports into which intake gas from the outlet passages flows, said outlet flange being located on downstream ends of the branch passages, and connecting means for connecting the intake manifold to the internal combustion engine;

wherein the first structural member is provided integrally with an inlet part forming at least part of the inlet passage and having the inlet connecting part, the first structural member also being provided integrally with said outlet flange and said connecting means, the outlet flange is formed integrally with the inlet part and has an integral extension part extending across and outside the inlet part;

fastening means are provided for fastening the outlet flange to a passage forming part of the internal combustion engine, some of said fastening means being disposed respectively on opposite sides of the inlet part, one of the some fastening means being provided on a base region of said extension part and positioned between the inlet part and one of the branch passages that is nearest to the inlet part, another one of the some fastening means being provided on an end region of said extension part, and said connecting means being provided integrally on an upstream end of said one branch passage nearest to the inlet part.

2. The intake manifold for an internal combustion engine according to claim 1, wherein the internal combustion engine has a plurality of cylinders arranged in a predetermined cylinder arranging direction, and the connecting means is located nearer to the inlet connecting part than a middle part of the intake manifold with respect to the cylinder arranging direction.

3. The intake manifold for an internal combustion engine according to claim 1, wherein the extension part of the outlet flange and the inlet part defining the inlet passage are connected by reinforcing ribs formed integrally with the first structural member.

4. The intake manifold for an internal combustion engine according to claim 1, wherein said first structural member is joined in face-to-face disposition with another structural member to define therebetween an intake gas collection chamber into which air flows from the inlet passage, and wherein the internal combustion engine has a plurality of cylinders, and the intake manifold has an expanded chamber having a passage area larger than that of the inlet passage, a plurality of branch passages branching out from the expanded chamber to carry intake gas to the plurality of cylinders, a second structural member joined to the first structural member to form the expanded chamber, and a third structural member joined to the first structural member to define the plurality of branch passages.

5. The intake manifold for an internal combustion engine according to claim 1, wherein said one branch passage nearest to the inlet part is positioned to overlap the extension part, the inlet part and the intake gas collection chamber, as viewed perpendicularly to a joining surface of the outlet flange.

* * * * *